United States Patent [19]

Vuillard

[11] Patent Number: 4,599,077

[45] Date of Patent: Jul. 8, 1986

[54] MODULAR TOY

[75] Inventor: Michel Vuillard, 93, rue du General de Gaulle, F-67640 Fegersheim, France

[73] Assignees: Michel Vuillard; Frederic Rubach, both of France

[21] Appl. No.: 629,712

[22] Filed: Jul. 11, 1984

[30] Foreign Application Priority Data

Jul. 18, 1983 [FR] France ..... 83 11936

[51] Int. Cl.[4] ..... A63H 33/04; A63H 17/00; A63H 33/08

[52] U.S. Cl. ..... 446/85; 446/94; 446/124; 446/431

[58] Field of Search ..... 446/85, 88, 93, 94, 446/95, 96, 102, 104, 124, 128, 457, 459, 469, 470, 471; 273/58 D, 58 E, 58 F; 280/1.188, 1.189, 1.194, 1.201, 208, 206, 207, 205

[56] References Cited

U.S. PATENT DOCUMENTS

| | | | |
|---|---|---|---|
| 1,762,374 | 6/1930 | Yancey | 434/155 X |
| 2,088,128 | 7/1937 | Benjamin | 446/95 |
| 2,208,049 | 7/1940 | Pajeau | 446/124 X |
| 3,286,391 | 11/1966 | Meneringhausen | 446/102 X |
| 3,453,773 | 7/1969 | Compton et al. | 446/458 |
| 3,473,257 | 10/1969 | Gambino | 446/94 X |
| 3,695,375 | 10/1972 | Splawinski | 280/208 X |
| 3,811,218 | 5/1974 | Salmon et al. | 446/94 |
| 3,893,707 | 7/1975 | Samsel | 280/208 |
| 4,109,398 | 8/1978 | Hida | 446/94 X |
| 4,217,724 | 8/1980 | Schoenfield et al. | 446/97 |

*Primary Examiner*—Robert A. Hafer
*Assistant Examiner*—D. Neal Muir
*Attorney, Agent, or Firm*—Hayes, Davis & Soloway

[57] ABSTRACT

A modular toy, comprising a base module (10) and various accessories. The base module comprises a circular side plate (11) supporting a stationary axle (12) on which are mounted two semi-spherical elements (13, 14) maintained in position by lateral tips (15) and (16) integral with the extremities of the axle (12). The central side plate (11) and the tips (15 and 16) are provided with tube-like connection means (21), into which may be inserted clips provided on the various accessories. This device allows a child to create a miniature playland by means of an infinite number of accessories adaptable to one or several base modules.

6 Claims, 8 Drawing Figures

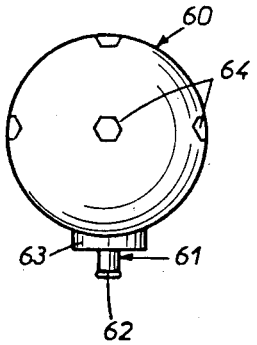
FIG. 5A
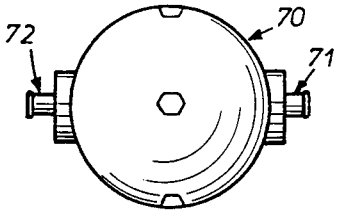
FIG. 5B
FIG. 6
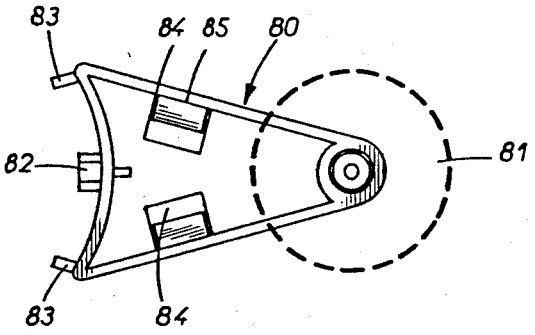
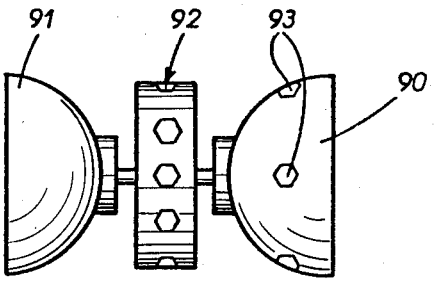
FIG. 7

MODULAR TOY

The present invention involves a modular toy comprising at least one composite base module having at least one circular side plate supporting a fixed axle and at least two like elements, capable of turning in symmetry and mounted on said one axle on each side of said side plate.

Modular toys are already known, comprising one or more base elements and a series of accessories attachable thereto.

The base elements usually consist of a static component to which other fixed or movable components may be attached. This is the case in the toy described in U.S. Pat. No. 4,217,724, which consists of a base element comprising a body made of one cylindrical piece and two semi-spherical units which may be quickly assembled, and on which is it possible to mount accessories such as, for example, wheels.

The modular toy according to the present invention essentially comprises a composite base module, itself movable, to which there may be adapted all sorts of accessories to achieve various combinations for creating a miniature playland limited only by the child's imagination.

To achieve this, the modular toy according to the invention the said two elements are rotatable on the said axle, and by the fact that the said side plate has a diameter smaller than the diameter of at least one portion of those elements.

For attaching elements which turn in symmetry, the base module preferably comprises two tips integral with the ends of the axle and provided with means for connecting either accessories or connecting units.

According to a preferred embodiment, the two elements which can turn in synchronism each are semi-spherical in shape, so that the base module has an essentially spherical shape and the two semi-spherical pieces are freely rotatable around the fixed axle supported by the side plate and maintained in position by the tips integral with the ends of the axle.

According to another embodiment, the base module may comprise at least two circular side plates, disposed in parallel relationship and supported by a common axle, at least one essentially cylindrical intermediary element disposed between two side plates situated nearby and two end pieces turning in symmetry, mounted on the end sections of the said axle, the said plates having a diameter which is less than that of at least one portion of the end pieces and/or of the intermediary element.

According to this embodiment, the end pieces are preferably semi-spherical and the intermediary elements, cylindrical.

The tips are preferably housed in the cylindrical openings disposed in the area of the poles of the semi-spherical end pieces.

To allow quick and easy assembly of the accessories and of the connecting units, the attachment means preferably comprises openings in the shape of cylindrical or polygonal tubes, regularly disposed about the peripheral surface of either of the side plates for the base module and on the exterior surface of the tips.

The toy advantageously comprises a series of accessories corresponding to the theme to be recreated, these accessories being adaptable to the base module and each comprising at least one clip disposed to be housed in one of the said tubes to ensure attachment of the corresponding accessory. These clips may have a polygonal profile so that the accessory may be rigidly afiixed to the base module. One side thereof may also be circular so that they may be rotated in relation to the base module. For this reason, the tubes in which the circular clips are to be inserted are preferably hexagonal. In this way, the lateral walls of the cylindrical clips are in tangential contact with the facets of the hexagonally shaped tubes, so that the clips may turn within said tubes.

The accessories preferably consist of differently shaped wheels designed to be mounted on the base module and providing stability for the toy. It is even possible for the accessories to include at least one propulsion means housed in a casing provided with clips for mounting it on the base module, and/or onto another accessory.

According to a particular embodiment, the propulsion means may include its own energy source and/or drive means.

To increase the number of possible combinations, certain accessories may comprise connecting means identical to those of the side plate and of the tips of the base module.

Thus, one of the most important accessories for achieving elaborate combinations comprises a connector ball, consisting of a sphere provided with one or more cylindrical projections for insertion into the hexagonal tubes, and with at least one tube to which may be adapted at least one accessory having a cylindrical projection.

Another important accessory consists of a rigid connecting means which may be, for example, triangular, provided with at least one projection for insertion into a mounting tube and with means for mounting accessories thereon.

This connecting means preferably comprises two projections respectively disposed at the two vertices of the triangle and designed to be inserted into two tubes on the side plate of the base module.

The present invention will be better understood with reference to the following description given by way of example with reference to the accompanying drawings, in which:

FIGS. 5A and 5B show elevations of the two connector balls;

FIG. 6 shows a plane view of a triangular connecting means; and

FIG. 7 shows an elevation of a variation of the base module.

Figure 1:
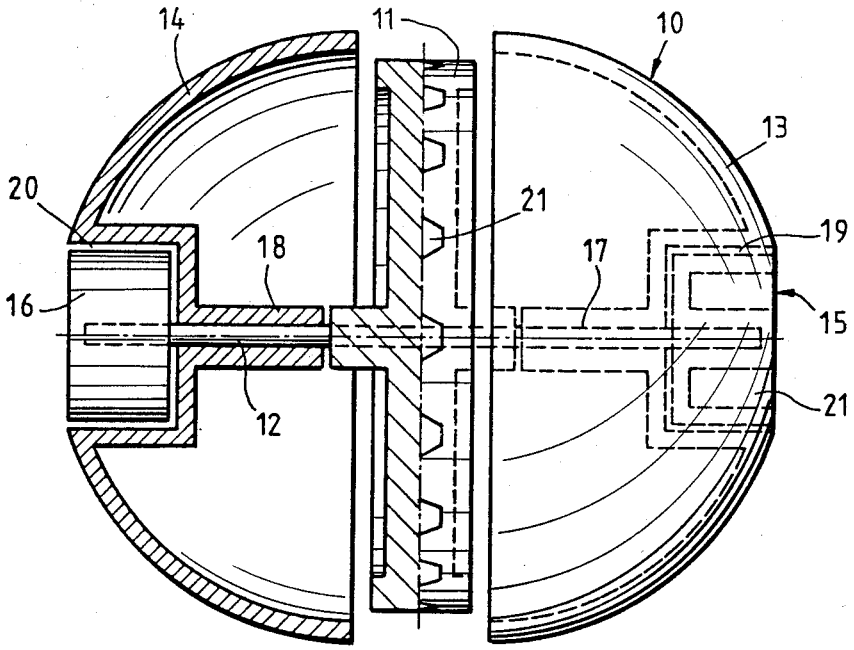
FIG. 1 represents an elevation, partially in section, of a preferred embodiment of the base module of the toy according to the invention.

With reference to FIG. 1, base module 10 essentially comprises circular side plate 11 supporting axle 12 perpendicular to its median plane, and two like elements 13 and 14 turnable in synchronism and, in this case, having the shape of semi-spherical shells. These two semi-spherical units 13 and 14 are freely rotatable on axle 12, on either side of central side plate 11. Tips 15 and 16 are mounted on the extremities of axle 12, for example set or glued onto it, so as to retain semi-spherical units 13 and 14 in position while allowing them to rotate freely around axle 12. Central side plate 11, semi-spherical units 13 and 14, and tips 15 and 16 are preferably molded of synthetic material. To ensure positioning of semi-spherical shells 13 and 14 on axle 12, they preferably comprise a core 17, 18 with a central opening of a diameter for rotation on the axle 12. At the level of their poles, they are provided with openings 19 and 20, respectively, for housing tips 15 and 16.

In the example described with reference to FIG. 1, semi-spherical units 13 and 14 are hollow. However, it is understood that these elements might also be solid, in which case cores 17 and 18 would be superfluous and the sections of axle 12 would engage directly in diametric openings traversing the body of the semi-spherical units.

Side plate 11 and tips 15 comprise means for attaching accessories and/or connecting pieces, said attachment means advantageously comprising hexagonal tube-like openings 21, designed to cooperate with the clips shown in greater detail with reference to FIG. 5.

As is clearly shown in FIG. 1, the diameter of side plate 11 is generally smaller than the diameter of semi-spherical units 13 and 14. This permits the base module to be displaced while rolling on the two semi-spherical units, side plate 11, axle 12 and tips 15 and 16 remaining stationary with respect to these two semi-spherical units.

Figure 2:
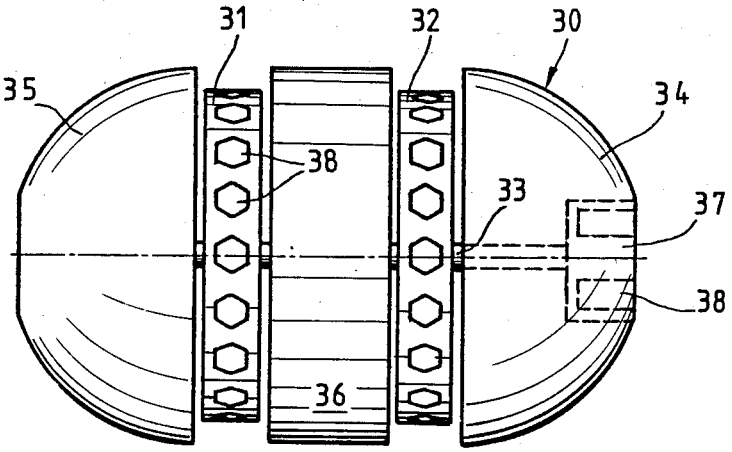
FIG. 2 shows an elevation of another embodiment of the base module.

FIG. 2 shows another embodiment of base module 30, comprising two side plates 31 and 32 disposed in coaxial parallel relationship and mounted on stationary axle 33, supporting two semi-spherical units 34 and 35 and central cylinder 36 disposed between side plates 31 and 32. The two semi-spherical units 34 and 35 are preferably identical or similar to the two semi-spherical units 13 and 14 of base module 10 shown in FIG. 1, and side plates 31 and 32 are preferably identical or similar to side plate 11 of the same base module. As before, semi-spherical units 34 and 35 are held in place on axle 33 by tips 37. As before, the side plates and the tips comprise tubes 38 designed to facilitate attachment of accessories or connecting pieces for attaching different base modules to each other.

It will be understood that the number of side plates comprising base module 30 is not limited to two, and that the number of intermediary elements 36, which may be increased as a function of the number of side plates comprising the module. Furthermore, the intermediary element could be cylindrical and the end pieces 34 and 35 could have a shape other than semi-spherical. Nevertheless, as before, side plates 31 and 32 have a smaller diameter than the diameter of at least one peripheral belt of the intermediary elements and/or of the end pieces. Because of this, the side pieces can remain stationary for attachment of accessories, while the toy may be displaced by rolling it on a surface contacting the peripheral zone of one of these elements.

Figure 3:
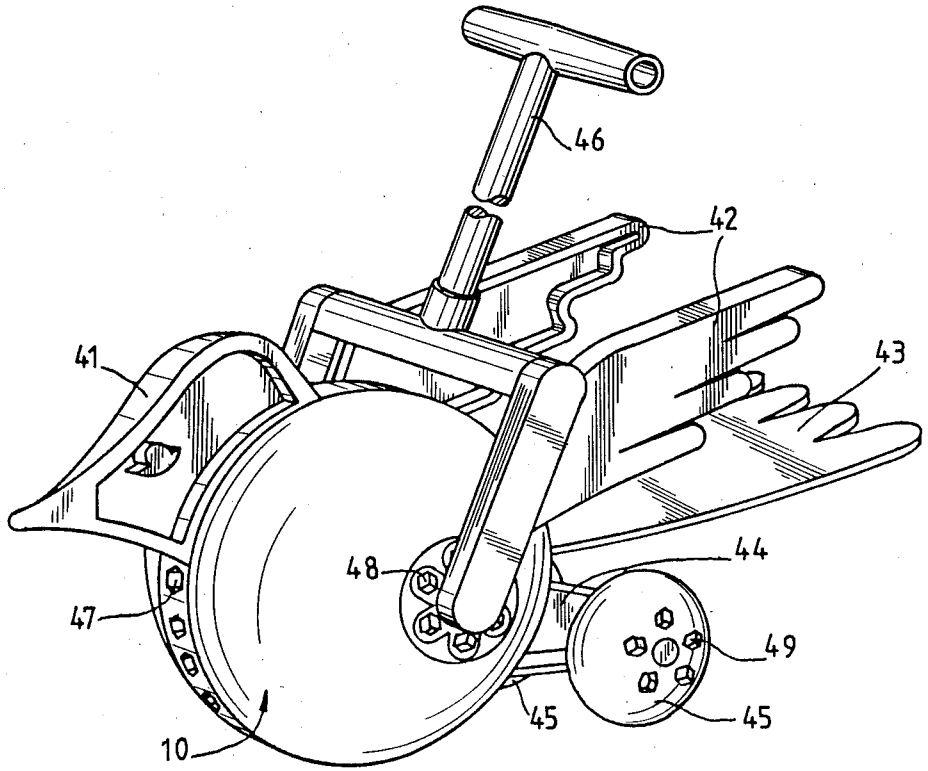
FIG. 3 shows an example made from the base module of FIG. 1 and various accessories.

FIG. 3 shows, by way of example, a construction made with the base module as shown in FIG. 1 combined with different accessories. Several accessories have been affixed to base module 10, such as a bird's head 41, wings 42, a tail 43, feet 44 attached to two wheels 45 to stabilize the unit, and a handle 46 so the child can push the toy thus constructed while rolling it on a surface. As shown in the drawing, a certain number of accessories has been affixed by clipping them into tubes 47 disposed on the periphery of the central side plate, while other accessories have been affixed in tubes 48 disposed on the outside surface of the lateral tips. As mentioned above, certain accessories, such as, for example, the wheels, may comprise tubes 49 providing a means for affixing other accessories.

Figure 4:
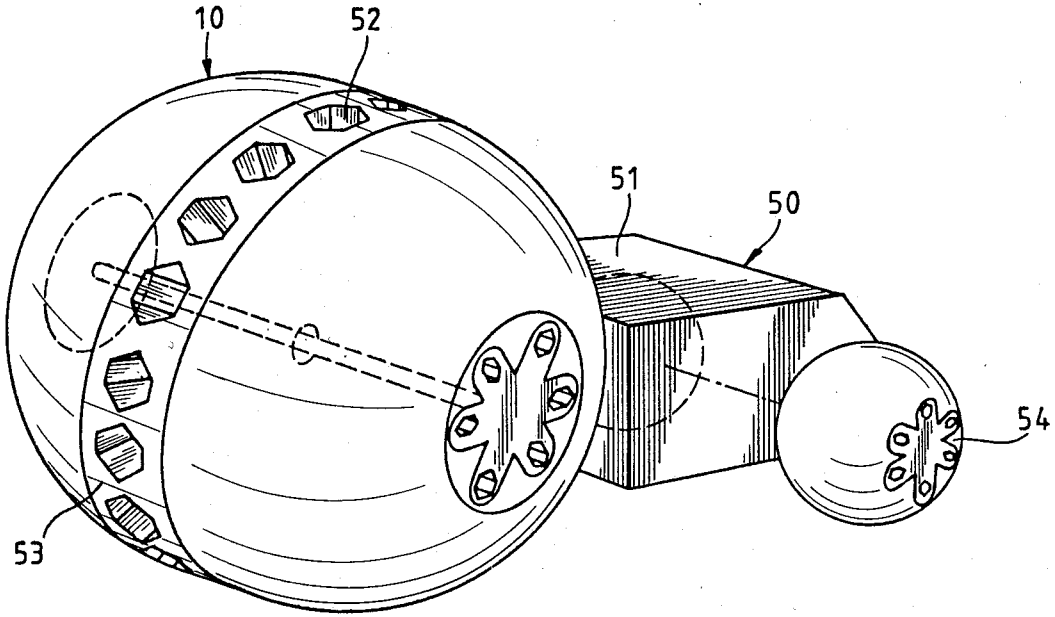
FIG. 4 shows the base module of FIG. 1 combined with various accessories.

FIG. 4 shows a partial assembly comprising a base module 10 such as shown in FIG. 1 and a propulsion module 50 provided with a casing 51 fastened with clips into one or more of the tubes 52 provided on central side plate 53. The propulsion module has moving wheels 54. This propulsion module may consist of any type of motor already known, such as, for example, spring motors, inertia motors, electric motors, etc. In certain cases, propulsion module 50 may have its own energy and/or drive source, particularly when the assembly is designed to include a remote control.

FIG. 5A shows a connector ball 60 comprising a single projection 61 designed to be engageable in a polygonal, preferably hexagonal, tube, with which the side plate of the base module or the semi-spherical units is provided. Since the projections are cylindrical and the tubes are hexagonal, the surface of the projections makes tangential contact with the inside surfaces of the tubes and allows rotation of the projections within the tubes. To prevent the projections from accidentally becoming dislodged from the tubes, the tubes may be provided with a retaining rim 62 axially supporting the projection into the interior rim of the corresponding tube. A contacting side plate 63 with a diameter greater than the diagonals of the tube is in contact with the exterior rim of the tube when the projection is in place. The connecting ball advantageously comprises several tubes 64 for attaching either decorative accessories or other connecting elements.

FIG. 5B shows another connector ball 70 provided, for example, with two projections 71, 72 identical to projection 61, which are diametrically opposed.

FIG. 6 shows a rigid triangular connecting means 80 which would permit, for example, attachment of stabilizing wheels 81 to a base module (not shown). This means preferably comprises a hexagonal tip 82 designed to be inserted within a fixation tube on the central side plate of the base module and two clamps or catches 83, designed to be inserted in two other tubes on the central side plate. On the two other sides there are provided two openings 84 within which there are two tubes 85 for attaching accessories with projections.

This connecting means could, of course, have a different shape or could comprise other tubes for attaching accessories, for example, on its lateral sides.

FIG. 7 shows another arrangement of the components of the elementary base module, in which the two semi-spherical units 90 and 91 are reversed in relation to the example shown in FIG. 1. Central side plate 92 comprises, as before, tubes for attaching accessories or connecting pieces. Semi-spherical units 90 and 91 may or may not comprise hexagonal tubes identical to those on the central side plate.

The present invention is not limited to the embodiments described, which are given by way of example, but may extend to any variation and modification evident to one skilled in the art.

I claim:

1. A modular toy having at least one composite base module comprising (a) a central circular plate (11), disposed normal to its central axis, supported on a fixed axle (12) which is coaxial with said central axis, integral with said central circular plate and extending axially on either side of said plate, said central circular plate (11) being provided with a pair of rotatable end elements (13, 14) respectively mounted on either side of said central circular plate for free rotation on said fixed axle, each rotatable end element having a central recess area wherein said fixed axle projects thereinto, the diameter of said central circular plate being smaller than the diameter of said rotatable elements;

(b) a plurality of openings (21) regularly disposed on the periphery of said central circular plate (11) and arranged for selective attachment of accessories to said central circular plate, so that said composite base module can provide different toys by selectively attaching different accessories to sid openings (21) of said central circular plate (11), wherein said base module may be displaced by rolling on said rotatable end elements (13, 14); and (c) retaining tips (15, 16) being fixed at the extremities of sid fixed axle (12), encompassed by said central recess areas and arranged so that said tips maintain said rotatable end elements (13, 14) in position for free rotation on said fixed axle (12), wherein said retaining tips further provide openings (21) for connecting accessories to said base module; and said rotatable end elements consist of semi-spherical elements (13, 14) mounted on either side of said central circular plate (11).

2. The toy according to claim 1, wherein at least two circular plates (31, 32) are supported on a common fixed axle (33) with at least one intermediate element (36) arranged between said two circular plates, and said rotatable end elements (34, 35) are respectively mounted on the end portions of said axle (33).

3. The toy according to claim 2, wherein said rotatable end elements (34, 35) are semi-spherical and said intermeidate element is cylindrical.

4. The toy according to claim 1, comprising accessories (41–45) adapted for attachment to said base module and each provided with at least one clip (61, 71) adapted for engagement in one of said openings (21, 38, 62) to thereby ensure connection of the corresponding accessory.

5. The toy according to claim 4, wherein said accessories comprise propulsion means (50) in a case (51).

6. The toy according to claim 5, wherein said propulsion means has its own source of energy and a drive means.

* * * * *